US009194024B1

(12) United States Patent
Butler

(10) Patent No.: US 9,194,024 B1
(45) Date of Patent: Nov. 24, 2015

(54) JEWELRY ARTICLE OF WHITE PRECIOUS METALS AND METHODS FOR MAKING THE SAME

(75) Inventor: John Robert Butler, Lafayette, LA (US)

(73) Assignee: Stuller, Inc., Lafayette, LA (US)

( * ) Notice: Subject to any disclaimer, the term of this patent is extended or adjusted under 35 U.S.C. 154(b) by 754 days.

(21) Appl. No.: 12/781,561

(22) Filed: May 17, 2010

(51) Int. Cl.

| | |
|---|---|
| ***C22C 5/06*** | (2006.01) |
| ***C22C 5/08*** | (2006.01) |
| ***C22F 1/14*** | (2006.01) |
| ***A44C 15/00*** | (2006.01) |
| ***A44C 25/00*** | (2006.01) |
| ***A44C 27/00*** | (2006.01) |

(52) U.S. Cl.
CPC . *C22C 5/06* (2013.01); *A44C 15/00* (2013.01); *A44C 25/00* (2013.01); *A44C 27/00* (2013.01); *C22C 5/08* (2013.01); *C22F 1/14* (2013.01)

(58) Field of Classification Search
CPC ..... C22C 5/06; C22C 5/08; C22F 1/14; A44C 15/00; A44C 25/00; A44C 27/00
USPC ..... 420/501–506; 148/430, 678
See application file for complete search history.

(56) References Cited

U.S. PATENT DOCUMENTS

| | | | | |
|---|---|---|---|---|
| 1,590,091 | A | | 6/1926 | Heusler |
| 1,614,752 | A | | 1/1927 | Mitchell |
| 1,628,673 | A | | 5/1927 | Leach |
| 1,643,304 | A | | 9/1927 | Korsunsky |
| 1,720,894 | A | | 7/1929 | Gray et al. |
| 1,863,612 | A | | 6/1932 | Assmann |
| 1,863,645 | A | | 6/1932 | Assmann |
| 1,888,188 | A | | 11/1932 | Tanabe |
| 1,896,410 | A | | 2/1933 | Leach |
| 1,913,423 | A | * | 6/1933 | Wise ..... 148/678 |
| 1,970,318 | A | | 8/1934 | Kern |
| 1,970,319 | A | | 8/1934 | Kern |
| 1,984,225 | A | | 12/1934 | McFarland |
| 2,031,113 | A | | 2/1936 | Leach |
| 2,052,142 | A | | 8/1936 | Kern |
| 2,052,143 | A | | 8/1936 | Kern |
| 2,196,302 | A | | 4/1940 | Hensel et al. |
| 2,196,306 | A | | 4/1940 | Hensel et al. |
| 2,196,307 | A | | 4/1940 | Hensel et al. |
| 2,221,285 | A | | 11/1940 | Hensel et al. |
| 2,719,085 | A | | 9/1955 | Schatz |
| 2,772,156 | A | | 11/1956 | Primose |
| 3,778,259 | A | | 12/1973 | Viglione |
| 3,811,876 | A | | 5/1974 | Harigaya et al. |
| 4,124,380 | A | | 11/1978 | Youdelis |
| 4,775,511 | A | | 10/1988 | Kono et al. |
| 4,810,308 | A | | 3/1989 | Eagar et al. |
| 4,869,757 | A | | 9/1989 | Eagar et al. |
| 4,973,446 | A | | 11/1990 | Bernhard et al. |
| 5,037,708 | A | | 8/1991 | Davitz |
| 5,039,479 | A | | 8/1991 | Bernhard et al. |
| 5,171,643 | A | | 12/1992 | Suzuki et al. |
| 5,558,833 | A | | 9/1996 | Zamojski |
| 5,817,195 | A | | 10/1998 | Davitz |
| 5,882,441 | A | | 3/1999 | Davitz |
| 5,919,320 | A | | 7/1999 | Agarwal et al. |
| 6,139,652 | A | | 10/2000 | Carrano et al. |
| 6,168,071 | B1 | | 1/2001 | Johns |
| 6,406,664 | B1 | | 6/2002 | Diamond |
| 6,726,877 | B1 | | 4/2004 | Eccles |
| 6,841,012 | B2 | | 1/2005 | Croce |
| 6,860,949 | B1 | | 3/2005 | Weber |
| 7,118,707 | B2 | | 10/2006 | Robinson |
| 7,128,792 | B2 | | 10/2006 | Menon |
| 7,128,871 | B2 | | 10/2006 | Davitz |
| 7,198,683 | B2 | | 4/2007 | Agarwal et al. |
| 8,136,370 | B2 | | 3/2012 | Bennett |
| 8,771,591 | B1 | | 7/2014 | Bennett |
| 2007/0251610 | A1 | | 11/2007 | Johns |
| 2008/0069722 | A1 | | 3/2008 | Johns |
| 2009/0205369 | A1 | | 8/2009 | Bennett |
| 2014/0003992 | A1 | | 1/2014 | Fogel |

FOREIGN PATENT DOCUMENTS

| | | | | |
|---|---|---|---|---|
| DE | 4213897 | | | 5/1992 |
| GB | 2255348 | A | | 4/1992 |
| GB | 2438198 | A | | 11/2007 |
| JP | 11217638 | | * | 8/1999 |
| WO | 9514112 | | | 5/1995 |
| WO | 9622400 | | | 7/1996 |
| WO | 9803688 | A1 | | 1/1998 |
| WO | WO 9803688 | A1 | * | 1/1998 |

OTHER PUBLICATIONS

Piwonka, Thomas S., "Molding Methods—Investment Casting", 1998, Metals Handbook, 2nd Edition, ASM International, p. 1-13.*
Nishihara, Takanori, English machine translation of JP 11-217638, Aug. 1999, p. 1-7.*
Pitwonka, Thomas S., "Molding Methods-Investment Casting", 1998, Metals Handbook, 2nd Edition, ASM Internationa, p. 1-13.
Roche, Michael T. and Goodwin, Frank E., "Improved Tarnish Resistant Sterling Silver", Sep. 2003, Silver Research Consortium, Durham, NC USA.

* cited by examiner

*Primary Examiner* — Roy King
*Assistant Examiner* — Caitlin Kiechle
(74) *Attorney, Agent, or Firm* — Roy Kiesel Ford Doody & Thurmon

(57) ABSTRACT

Jewelry articles made from a precious metal alloy having a color that is substantially white and comparable to that of platinum alloys, having liquidus and solidus temperatures comparable to that of white gold alloys, having a relatively slow solidification time when poured from a molten state, having substantial resistance to tarnishing under conditions normally encountered during ordinary human wear, having a cast hardness of about 140 Vickers, and that can be age hardened to at least about 240 Vickers, and whose yield point can be substantially strengthened via age hardening. The preferred composition of the alloy is about forty to fifty-five percent by weight silver; about fifteen to thirty-five percent by weight palladium; about fifteen to twenty-five percent by weight copper; and up to about three percent by weight zinc and/or silicon and up to about one percent by weight of a grain refiner such as iridium and/or ruthenium.

49 Claims, 3 Drawing Sheets

Fig 1A
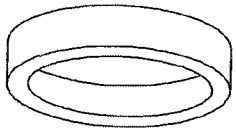
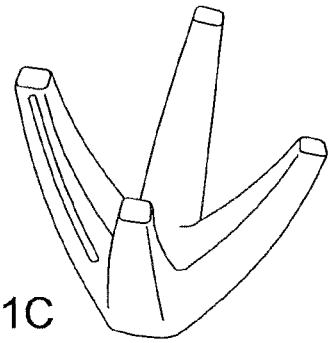
Fig 1C
Fig 1B
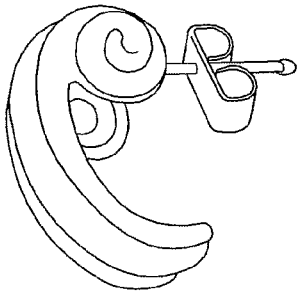
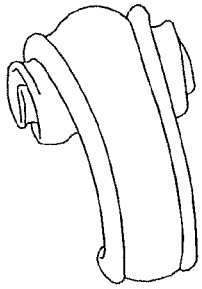
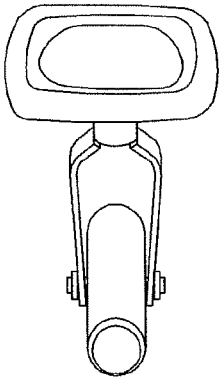
Fig 1D
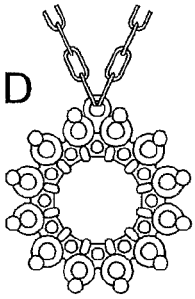
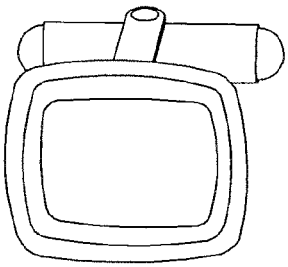
Fig 1F

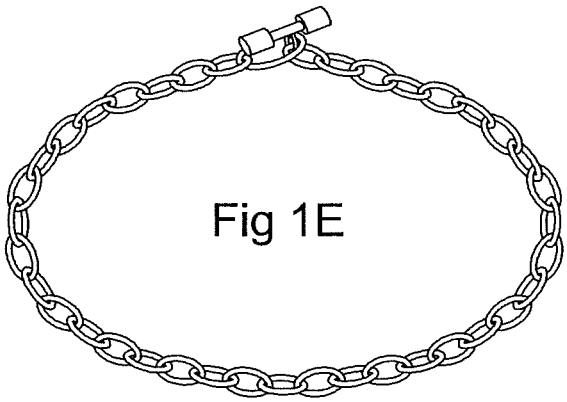
Fig 1E
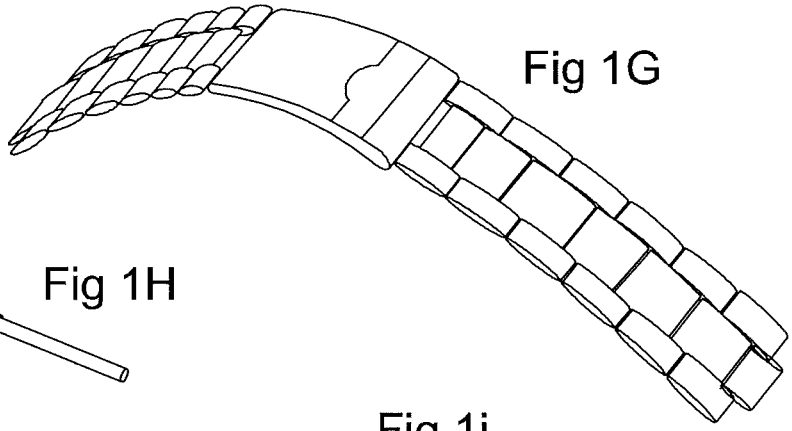
Fig 1G
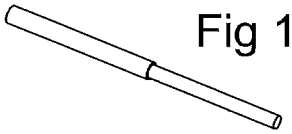
Fig 1H
Fig 1i
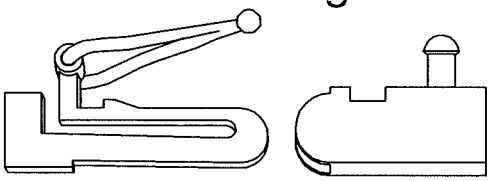
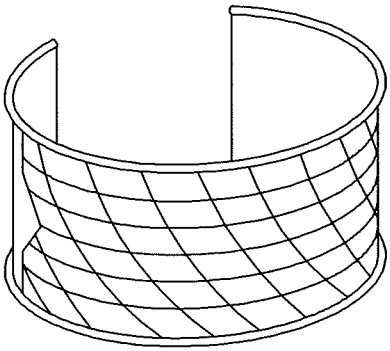
Fig 1J

Composition of Preferred Alloy

| Component | Acceptable Range* | Preferred Range* | Preferred Percentage* |
|---|---|---|---|
| Silver | 40 to 55 % | 51 to 55 % | 53.75 % |
| Palladium | 15 to 35 % | 22 to 27 % | 24.75 % |
| Copper | 15 to 25 % | 17 to 23 % | 20.75 |
| Zinc / Silicon | 0 - 3 % | 0 - 3% | 0 - 3% |
| Grain Refiner | 0 - 1 % | 0 - 1 % | 0 - 1% |

* All percentages are by weight

Figure 2

Color Testing

| | L* | a* | b* | YI D (1925 C/2°) |
|---|---|---|---|---|
| Pref. Alloy (fig. 1) | 82.39 | 0.86 | 6.54 | 14.66 |
| 14K White Gold (PD 403) | 84.57 | 0.70 | 10.385 | 21.75 |
| 14K White Gold (Ni 401) | 86.62 | 0.26 | 9.31 | 18.94 |

Figure 3

JEWELRY ARTICLE OF WHITE PRECIOUS METALS AND METHODS FOR MAKING THE SAME

BACKGROUND OF THE INVENTION

1. Field of the Invention

The invention relates to precious metals, precious metal alloys, and jewelry made therefrom.

2. Prior Art

Jewelry pieces formed from precious metals that are white in color are highly desirable among jewelry consumers. There are many ways to achieve white pieces. However, if one requires that the piece be formed of precious metal, the options become much more limited. Precious metals include silver and gold plus the platinum group metals, namely, platinum, palladium, ruthenium, rhodium, osmium, and iridium.

One option for making a precious metal piece that is white in appearance is to make the piece from platinum. Platinum provides excellent luster, and it is ductile and malleable, making it a good material for making jewelry. Platinum is also highly resistant to corrosion and to wear, when alloyed to increase its hardness. However, platinum has significant drawbacks. Platinum has a very high melting point relative to gold: 3215° F. versus 1948° F. for gold. Molten platinum also cools and solidifies very quickly—on the order of about one second after pouring. The high melting point of platinum significantly effects the efficiency of using platinum in traditional jewelry processes, such as investment casting.

In investment casting, also called lost wax casting, a sprue or "tree" is formed of wax. Wax models of the items to be cast are mounted on each branch of the wax tree. Traditionally, beeswax was used, though today many different types of wax as well as plastics and even frozen liquid metals such as mercury are used. An investment mold is formed around the tree using plaster, ceramics, or other suitable materials. Once the mold has hardened, the wax is removed, typically by heating it and allowing it to melt and run out of the mold. This leaves a void in the mold the same shape as the tree. Molten precious metal may then be poured into the mold. The liquid metal will flow through the mold, filling the space left by the wax. In so doing, the liquid metal will fill the spaces left by the wax models, thereby forming a precious metal casting of the jewelry items. When the metal has hardened, the plaster mold is removed, leaving a precious metal "tree" that should be substantially identical to the wax tree present at the outset of the process. The pieces may then be removed from the tree while the branches and trunk may be reused.

It will be appreciated that the molten metal must remain liquid long enough to fill the tree. Thus, the rate at which a metal cools and solidifies determines how large a tree may be used. Stated differently, metals that cool and solidify quickly can only form a few pieces at a time via lost wax casting.

Because of the rapid cooling rate of platinum, special measures are taken to form platinum pieces via investment molding. The mold is heated to a high temperature, typically about 1500° F. The entire mold is rotated to use centripetal force to quickly pull the molten platinum into the peripheral cavities in the tree. The crucible is also rotated so that the molten platinum leaving the crucible will exit at a higher flow rate, again to promote more rapid filling of the mold.

To achieve an acceleration of the molten platinum flow rate from the rotation of the crucible, it will be appreciated that the outflow aperture should be on the side of the crucible, rather than at the top or the bottom. If the crucible is rotating about a top to bottom axis, for centripetal force to accelerate the flow rate of the molten platinum exiting the crucible, the outflow aperture must be on the periphery of the crucible, rather than on the axis. The outflow aperture, then, will rotate about the axis of rotation of the crucible. For the molten platinum to flow into the mold, the mold must remain aligned with the aperture. Accordingly, the mold is positioned at an approximate right angle to the axis of rotation of the crucible and the mold also revolves about the axis of rotation of the crucible, in synchronicity with the crucible. Thus, in platinum investment casting, the mold is typically positioned laterally relative to the crucible, rather than vertically beneath the crucible and the mold has two degrees of motion: the mold revolves around the crucible's axis of rotation and the mold rotates about its own axis. This rotational molding process is obviously much more complicated than static molding wherein molten metal is simply poured out of a crucible into a stationary, though often pre-heated, mold. Despite the additional effort, typical yields for rotational investment casting of most platinum alloys, with a pre-heated (~1500° F.) mold, are no more than about five pieces per mold.

Another significant drawback to platinum is its price. Platinum is currently trading at about (US) $1725 per troy ounce, making it very expensive as a jewelry making material.

Another option for making white jewelry pieces is white gold. White gold refers to a group of gold alloys that typically comprise gold and nickel and/or palladium. The majority of the white gold alloy will be gold, which also makes white gold relatively expensive, as gold is currently trading at about (US) $1157 per troy ounce.

However, the fact that white gold is primarily gold, means that white gold alloys are generally corrosion resistant and adequately ductile and malleable for jewelry making purposes.

White gold is superior to platinum in casting efficiency. Depending upon the specific composition of the alloy, white gold will melt between about 1600° F. and 1800° F. Molten white gold also solidifies much more slowly than platinum, typically on the order of about five seconds, when poured into a static mold pre-heated to about 900° F. As a result, lost wax casting "trees" containing many more finished pieces may be obtained with white gold, than with platinum. Trees containing fifty to seventy-five white gold pieces are common.

In addition to cost, another significant drawback is that much white gold, despite its name, is not really white. Rather, it is to varying degrees, somewhat yellow. As a result, white gold pieces are commonly plated with rhodium. Rhodium gives a superb white finish, even compared to the highest quality white gold. However, the rhodium plating is subject to wear, which can be an especially significant issue with a high wear item like a ring. Any wear of the rhodium plating will almost inevitably be uneven. This will result in a contrast between the remaining rhodium plating and the underlying piece. This contrast will seldom be aesthetically pleasing and may be particularly jarring when the underlying piece has a high degree of yellow coloration.

Rhodium is very expensive, currently trading at about (US) $2780 per troy ounce. The use of white gold, to the extent that it involves rhodium plating, will increase the overall cost of the piece and add a step to the manufacturing process. Rhodium plating will also make the piece subject to wear, such that replating will often be required to maintain the appearance of white gold pieces over their lives.

Another problem with white gold is that much of it, especially in the United States, includes nickel. Nickel can be used to obtain an alloy that is sufficiently white so as to not require rhodium plating. However, nickel can also cause an allergic contact dermatitis in persons susceptible to the allergy and who come into contact with the metal. Thus, the presence of nickel in white gold poses an allergic risk to a subset of the population. Nickel can also increase the brittleness of the piece.

Still another option for white jewelry pieces is silver. One of the primary drawbacks of silver is its tendency to tarnish. When polished, silver has a highly lustrous, white appearance. However, after only a brief time in service, it will tarnish, such that frequent polishing is required to maintain the appearance of silver pieces.

Another consideration with silver is its weight. Though lighter than gold and platinum, (the density of gold is about 19.3 grams per cubic centimeter; platinum, 21.4 grams per cubic centimeter), silver has a nice weight at about 10.5 grams per cubic centimeter. By comparison, fourteen karat gold alloys have a density from about 12.9 to 14.6 grams per cubic centimeter, depending upon the make-up of the non-gold portions of the alloy. Likewise, ten karat gold alloys have a density of about 11.4 grams per cubic centimeter. Although pieces made of silver would feel light compared to pieces made of pure gold or platinum, the more relevant comparison is their feel compared to pieces formed of common jewelry making alloys. As illustrated above, silver is only about twenty percent less dense than fourteen karat gold and only about four percent less dense than ten karat gold. Thus, pieces made of silver will not feel markedly lighter than comparably sized pieces made of fourteen karat, or especially ten karat, gold.

Silver has a melting point of about 1763° F. Thus, its melting temperature is comparable with that of gold, less than two hundred degrees (F) separating the two. Like white gold, silver solidifies much more slowly than platinum—remaining liquid on the order of about five seconds when poured into a static mold pre-heated to about 800° to 1000° F.

An advantage of silver is its cost. Silver is currently trading at about (US) $18.00 per troy ounce. Thus, pieces made of silver will cost much less than comparable pieces made of gold or its alloys.

Another advantage of silver is its ductility and malleability. Silver is highly ductile and malleable, making it a good choice for forming jewelry.

Yet another option for white jewelry pieces is palladium. Palladium is whiter than platinum. Thus, unlike white gold, rhodium plating is not needed for palladium jewelry. Palladium has a melting point of about 2831° F., which is higher than gold but much lower than platinum. When molten, common palladium alloys also cool more slowly than platinum, typically solidifying in about five seconds after pouring into a static mold pre-heated to about 900° F., allowing more pieces to be cast using lost wax methods than with platinum. "Trees" including ten to twenty pieces can often be cast using palladium.

At 12.0 grams per cubic centimeter, palladium is more dense than silver, though less dense than gold or platinum. Palladium is very resistant to tarnishing under normal atmospheric conditions. It is also sufficiently ductile and malleable to be worked as jewelry.

A principle drawback of palladium, relative to silver, is its cost. Palladium currently trades at about (US) $515 per troy ounce. This makes it more affordable than gold or platinum, but relatively expensive compared to silver.

In view of the foregoing, precious metal alloys meeting the following objectives and jewelry manufactured therefrom are desired.

OBJECTS OF THE INVENTION

It is an object of the invention to provide a precious metal alloy that has a color that is substantially white.

It is a further object of the invention to provide a precious metal alloy that has a color that is comparable to that of platinum alloys.

It is a still further object of the invention to provide a precious metal alloy that has liquidus and solidus temperatures comparable to that of white gold alloys.

It is yet another object of the invention to provide a precious metal alloy having a relatively slow solidification time when poured from a molten state.

It is another object of the invention to provide a precious metal alloy having substantial resistance to tarnishing under conditions normally encountered during ordinary human wear.

It is still another object of the invention to provide a precious metal alloy that has a cast hardness of sufficient softness to allow the alloy to be worked using traditional bench jewelry methods.

It is yet another object of the invention to provide a precious metal alloy that can be age hardened.

It is still another object of the invention to provide a precious metal alloy whose yield point can be substantially strengthened via age hardening.

It is still a further object of the invention to provide a precious metal alloy comprising at least seventy-five percent by weight precious metals.

SUMMARY OF THE INVENTION

The invention comprises jewelry articles made from a precious metal alloy that has a color that is substantially white and comparable to that of platinum alloys, that has liquidus and solidus temperatures comparable to that of white gold alloys, that has a relatively slow solidification time when poured from a molten state, that is resistant to tarnishing under conditions normally encountered during ordinary human wear, that has a cast hardness of about 140 Vickers, that can be age hardened to at least about 240 Vickers, and whose yield point can be substantially strengthened via age hardening. The preferred composition of the alloy is about forty to fifty-five percent by weight silver; about fifteen to thirty-five percent by weight palladium; about fifteen to twenty-five percent by weight copper; and up to about three percent by weight zinc and/or silicon and up to about one percent by weight of a grain refiner such as iridium and/ruthenium.

BRIEF DESCRIPTION OF THE DRAWINGS

FIGS. 1A-1J illustrate numerous jewelry articles that may be made from a preferred embodiment of the alloy.

FIG. 2 is a chart illustrating the preferred composition of the alloy.

FIG. 3 illustrates the results of a comparative CIELAB and YI D value of the preferred embodiment and two fourteen karat white gold alloys.

DETAILED DESCRIPTION OF THE INVENTION

A precious metal alloy is disclosed. The alloy is particularly suited for making jewelry pieces 1 such as rings 1A, earrings 1B, settings 1C, pendants 1D, chains 1E, cuff-links 1F, watch bands 1G, watch pins 1H, clasps 1I, and bracelets 1J, and particularly pieces 1 that are subject to high wear such as rings or watch bands. It may also be used for parts that need to be hardened to resist abrasion such as watch pins or that need high spring strength such as stone settings or clasps.

Alloys are commonly formed by melting the components of the alloy, mixing them together in the liquid state, and allowing them to cool and solidify into a solid solution. Though there are other methods of alloy formation, such as powder metallurgy and ion implantation, the preferred method of forming the alloy of the present invention is by mixing the molten components together and letting them cool. Generally, the process comprises melting the component materials and blending them together, typically via induction heating in crucibles appropriate for white gold alloy formation. The resultant alloy may then be poured through water to create grain shot suitable for weighing, drying, and casting.

The primary component of the alloy is silver. Silver will preferably be present in the range of about forty to fifty-five percent by weight, more preferably about fifty-one to fifty-five percent by weight, and most preferably about 53.75 percent by weight. Silver provides ductility and malleability to the alloy and a desirable color. In combination with copper, discussed below, silver will also help make the alloy susceptible to age hardening. Because of its relatively low price per ounce, silver will also help make the alloy economical.

A second component of the alloy is palladium. Palladium is preferably present in the range of about fifteen to thirty-five percent by weight, more preferably about twenty-two to twenty-seven percent by weight, and most preferably about 24.75 percent by weight. Palladium will provide a desirable bright white color to the alloy, preventing it from looking too "silvery." Palladium will also help prevent oxidation or corrosion of the alloy. Additionally, palladium will raise the melting point of the alloy.

As noted above, palladium is whiter than platinum. As discussed in more detail below, the finished alloy, because of the significant palladium content, will have a color similar to that of 950 platinum. Palladium content higher than thirty-five percent could be used. However, this would merely result in an increase in the cost of the alloy and an increase in its melting point without significant improvement to its color or other characteristics.

A third component to the alloy is copper. Copper is preferably present in the range of about fifteen to twenty-five percent by weight, more preferably about seventeen to twenty-three percent by weight, and most preferably about 20.75 percent by weight. Copper helps to homogenize the alloy and it also hardens the alloy.

Significantly, copper, in conjunction with silver, helps make the alloy susceptible to precipitation hardening or age hardening. The preferred ratio of silver to copper is about 2.6:1. The ratio of silver to copper is believed to be what makes the alloy more susceptible to age hardening. As the silver to copper ratio approaches 1:1, the age hardening characteristics of the alloy will increase. However, when the silver content gets too high, tarnishing starts to become an issue. Similarly, when the copper content gets too high, off-white coloration becomes an issue. Accordingly, the preferred silver to copper ratio is between about 3:1 and 2:1. Silver to copper ratios of this order are expected to result in substantial increases in the hardness of the alloy upon precipitation hardening treatment.

Up to three percent, by weight, zinc may be added to the alloy. In the preferred embodiment, 0.75 percent zinc, by weight, is present. Zinc is intended to help prevent oxidation of the finished alloy. Palladium is significantly corrosion and tarnish resistant under atmospheric conditions. Accordingly, zinc may be omitted altogether, particularly when higher concentrations of palladium are present.

Zinc has other functions/effects in the alloy. It will lower the melting point, for example. However, zinc will also increase brittleness quickly, which can be a problem as concentrations exceed three percent.

An alternative to zinc is silicon. Silicon will also help prevent oxidation of the alloy. It may be used in place of, or in combination with, zinc. The addition of silicon may cause the grain size of the alloy to become enlarged, which is generally considered aesthetically undesirable. To combat this, up to about one percent of a grain refiner such as ruthenium or iridium may be added to the alloy. A grain refiner may be added anytime enlarged grain size is expected to be a problem, such as when slow cooling of the molten alloy is desired.

The preferred embodiment of the alloy is shown in the chart in FIG. 2. This alloy has several characteristics that make it advantageous for the manufacture of jewelry.

The preferred embodiment of the alloy has a density of about 10.4 grams per cubic centimeter (+/−0.5 grams). This gives it a weight that is comparable to silver and close to ten karat gold. Pieces manufactured from the alloy will have a nice heft similar to comparably sized pieces of silver or ten karat gold.

The preferred embodiment of the alloy has a solidus temperature of about 1652° F. and a liquidus temperature of about 1742° F. This is comparable to yellow gold alloys (10K-18K), which have solidus temperatures as low as about 1600° F. and liquidus temperatures as high as about 1850° F. Having solidus/liquidus temperatures in the range of gold alloys is important because it will allow the alloy to be cast using materials and methods similar to those used for casting pieces from gold alloys. Accordingly, it is a significant advantage of the invention as compared to platinum alloys that the preferred alloy will melt between 1600° F. and 1800° F.

The preferred embodiment of the alloy, when molten, will remain liquid for about five seconds after pouring, when poured into a static mold pre-heated to about 900° F. This compares extremely favorably to platinum and is comparable to solidification times for white gold alloys. Lost wax trees containing thirty to fifty cast pieces may be formed using this alloy because of its long solidification time and lower solidus point compared to platinum.

As discussed above, common investment casting techniques for platinum require a rotating crucible, a rotating mold turning in two directions, and a pre-heated mold (about 1500° F.). Of course, the crucible must be heated to well above the liquidus temperature for platinum alloys—about 3300° F., depending upon the particular alloy. Such efforts still only result in a solidification time of about 1 second for most platinum alloys, and an investment yield of about four to five pieces per cast. The ability to use static casting techniques and the ability to obtain significantly more investment pieces per casting all without operating at the higher temperatures associated with platinum, are significant advantages of the present alloy relative to platinum.

The preferred alloy will have a white lustrous color and finish. On the CIELAB scale, the preferred alloy will be about 83.20 and can be expected to vary from about 80 to about 90 on the L* coordinate, though L* values between 90 and 100 would certainly be acceptable. The a* coordinate will preferably be about 0.86 and can be expected to vary from about 0.3 to about 1.0. Ranges in the a* coordinate from about −1 to +1 should be acceptable. Likewise, the b* coordinate will preferably be about 6.20 and can be expected to vary from about 5.2 to about 7.0. Remaining below about 7.0 on the b* coordinate should be acceptable.

To put the foregoing in context, white is 100 on the CTFLAB L* coordinate and black is zero. The a* coordinate measures the red/green continuum, where a positive value indicates the presence of red and a negative value indicates the presence of green. Values on the a* coordinate near zero are believed to be important, as these colors are easily visible in white metals, though metals that are faintly pink in hue can be commercially desirable. The b* coordinate measures the yellow/blue continuum, where a positive value indicates the presence of yellow and a negative value indicates blue. For objects that are white or nearly white, it is important to have a low b* coordinate. The b* value may be slightly negative, as white hues may have a fair amount of blue in them and still appear white to the viewer. However, relatively small amounts of yellow can impact viewer perception negatively.

A few examples will provide further context: Pure silver has an L* value of about 96, an a* value of about −0.6 and a b* value of about 3.6. Pure rhodium has an L* value of about 89, an a* value of about 0.5, and a b* value of about 3.3. Pure platinum has an L* value of about 80, an a* value of about 1.6 and a b* value of about 6.8. Pure palladium has an L* value of about 82, an a* value of about 0.3 and a b* value of about 3.7. Common platinum alloys, such as 950 platinum (ruthenium), have L* values of about 87, a* values of about 0.5, and b* values of about 4.0. See, U.S. Pat. No. 5,372,779 to Reti.

Another significant measure of color is yellowness. White items with a yellow tint are commonly perceived as undesirable. Thus, the yellow content of white gold is a concern. One test for yellowness is the Yellowness Index (YI). To be considered white gold, an alloy must have a YI score lower than 32. Alloys scoring below 19 are considered class 1 white. Alloys between 19 and 24.5 are considered grade 2 white, and alloys between 24.5 and 32 are considered grade 3 white. With white golds, rhodium plating is either recommended or required for alloys that are class 2 or class 3 white. To avoid needing to plate, a white gold alloy intended for use in jewelry will preferably be below 19 on the Yellowness Index.

A CIELAB test was run on a sample of the preferred alloy and two white gold alloys for comparison. Yellow index (YI D1925)C/2° was determined for all three alloys as well. The alloy of the present invention had the composition set forth in FIG. 2. The first white gold alloy was a fourteen karat white gold (PD 403). Its composition was gold, 58.24%; silver, 26.306%; palladium, 10.44%; copper, 4.585%; zinc, 0.418%; iridium, 0.008%; and phosphorous, 0.003%. The second white gold alloy was also a fourteen karat white gold (Ni 401). Its composition was gold, 58.24%; copper 24.172%; nickel, 11.145%; zinc, 6.435%; rhenium, 0.005%; and phosphorous, 0.003%. All percentages are by weight.

Samples were all one inch square pieces. The surface of each sample was prepared identically, by first polishing with 600 grain sand paper and then 800 grain sand paper, and then a final polish with green rouge (Grobetlux compound Green, 2000 grit).

As can be seen from the results reported in FIG. 3, the preferred alloy of the present invention had an L* value that was slightly lower (less white) than that of either white gold alloy, and an a* value that was higher (more red) than the a* values of either white gold alloy. However, the b* value of the preferred alloy, a measure of yellowness, was substantially lower than the b* value of either white gold alloy.

This mirrored the YI D test. The Ni 401 white gold had a YI D value of 18.94—at the upper end of class 1 white. The PD 403 white gold had a YI D value of 21.75, placing it in the grade 2 white category. By contrast, the preferred alloy scored 14.66 on the YI D, placing it squarely within the class 1 white range. Accordingly, a jewelry article made of the preferred alloy should not require rhodium plating to appear white.

When viewed side-by-side, the alloy of the present invention appeared whiter than either of the comparative pieces, despite the lower L* value of the preferred alloy. It was markedly whiter in appearance than the PD 403 alloy. This illustrates the effect of yellow tint in white alloys.

The ability of the preferred alloy of this invention to achieve a high degree of whiteness without using nickel is also noteworthy. Comparable whiteness can be achieved in white gold by using nickel. However, the presence of nickel can trigger allergies in some wearers, and nickel can render the metal more brittle. It is a significant advantage of the present alloy to be able to achieve class one whiteness without using nickel.

The preferred alloy also has good malleability and ductility. Maximum elongation was determined to be about thirty-four percent ($L_0$=1.0 inch). Malleability was tested using a piece of one inch stock of the alloy run through cold rollers. An approximately sixty percent reduction in thickness was obtained with substantially no edge cracking. No annealing was done to facilitate rolling.

When cast, the preferred embodiment of the alloy will yield pieces that are about 140 on the Vickers hardness scale. This can be compared to fourteen karat gold which will typically have a cast hardness of between about 125 to 165 on the Vickers scale and 950 platinum (ruthenium alloy) which has a cast hardness of about 135 on the Vickers scale. Thus, bench jewelers will be able to work with pieces cast from the alloy in much the same way that they work with fourteen karat gold or 950 platinum (ruthenium). However, the preferred embodiment offers a significant advantage over fourteen karat gold in that it may be age hardened to about 240 on the Vickers scale. This is well above the typical upper limit for age hardened fourteen karat yellow gold alloys of about 180 Vickers and is comparable to the typical upper limit for most age hardened eighteen karat alloys of about 230 Vickers. Conventional platinum alloys suitable for jewelry making are notoriously difficult to age harden. See, e.g., U.S. Pat. No. 6,562,158 to Kretchmer for a discussion of the same. Although conventional platinum alloys can generally be hardened via cold working, the ability to age harden the alloy of the present invention will give it significant advantages over most conventional platinum alloys.

Age hardening the alloy will also significantly increase its yield point—that is, the stress at which the alloy begins to deform plastically. When cast, the preferred alloy will have a yield point between about 23 and 30 kilo-pounds per square inch (ksi) and preferably about 28.9 ksi. After age hardening, the yield point will increase to between about 2900 and 3300 ksi and preferably about 3300 ksi. The post-hardening yield point for the preferred embodiment of the alloy has been tested to 3334 ksi. This significant increase in yield strength has implications for the alloy as a jewelry manufacturing material. Prior to age hardening, the piece may be mechanically worked. Setting prongs, for example, may be physically bent into a desired position and they will not snap back to the original location. After age hardening, the same prongs, if physically expanded to allow insertion of a stone, would attempt to snap back into position, thereby placing the stone under tension and holding it in place. Thus, age hardening will significantly increase the spring strength of the alloy.

For example, a jewelry item may be cast using standard casting methods. The jewelry item may then be worked to its desired finished shape. This may be easily accomplished using standard bench jewelry techniques because the piece is at its relatively soft cast hardness and pre-age hardening yield strength. After the piece has been worked to its desired shape, it may then be age hardened. Thus, a ring might be formed via casting. The bench jeweler may work it to create a finished ring with a stone setting. The entire ring may then be age hardened, significantly increasing the wear resistance of the ring and simultaneously increasing the yield strength of the metal. This will significantly increase the spring power of the setting. Similarly, a clasp or earring nut might be formed via casting and then age hardened to increase both the wear resistance and the spring power of the clasp or nut.

The enhanced spring power will significantly increase the gripping strength of any setting formed of the preferred alloy. As noted above, the cast strength prongs of the setting may be easily formed to the appropriate shape for the intended stone. In one application, the setting may be age hardened before the stone is mounted. After age hardening, the prongs may be spread slightly to allow the stone to be inserted. Once the stone is in place, the prongs will be released, allowing them to snap back toward their original position. The prongs will be impeded from reaching this position by the stone, and the prongs will thereby hold the stone in place. The increased spring strength of the prongs will result in the prongs gripping the stone much more firmly.

In another application, the stone may be fully mounted in the setting prior to age hardening. The setting and stone—or the complete ring or other jewelry piece, for that matter—may then be placed in the oven for age hardening Because of the increased hardness, displacing the prongs from their position securing the stone will be much more difficult after age hardening, thereby resulting in a more secure engagement of the stone.

Age hardening is performed by heating the jewelry component or other piece to be hardened to about 600 to 800° F. and most preferably to about 700° F. for about thirty minutes. This compares favorably to typical age hardening times for white gold (See, U.S. Pat. No. 7,135,078 to Agarwal, 1-4 hours at 400° C./750° F.). The component is placed in an oven pre-heated to the desired temperature for the requisite amount of time. The oven may be heated under normal atmospheric conditions or the atmosphere may be controlled. Afterwards, the component is removed from the oven and allowed to air cool.

When heated in normal atmospheric conditions, very mild oxidation of the alloy was observed. All oxidation was easily and quickly removable via polishing. Heating under a controlled atmosphere consisting of substantially pure hydrogen was also conducted. No oxidation was observed when the alloy was heated in a hydrogen atmosphere. Somewhat surprisingly, given palladium's affinity for hydrogen, no noticeable embrittlement of the alloy was observed.

The temperatures and times required for the preferred alloy to be age hardened are relatively low and short enough that heat damage to diamonds should not be a concern. (See, e.g., U.S. Pat. No. 7,412,848 to Johnson—diamonds can withstand temperatures up to 1000° C. (1832° F.)). This allows pieces to be age hardened after stones are set, as discussed above.

Although the preferred alloy has been described primarily as being used to cast individual jewelry pieces, it should be entirely suitable for continuous casting to form rods or sheets. A grain refiner, such as ruthenium or iridium, will preferably be used when the alloy is used for continuous casting. Otherwise, conventional continuous casting methods suitable for use with white gold alloys would be implemented. In this way the alloy contrasts favorably with platinum alloys, which are practically impossible to use in continuous casting because of the extremely high temperatures required.

The alloy's resistance to tarnishing was tested in comparison to silver. A sterling silver ring and a substantially identically sized ring cast from the preferred alloy were treated with liver of sulphur solution (potassium polysulphide). The test solution was formed by dissolving approximately one tablespoon of commercial liver of sulphur powder (Griffith's) into twelve ounces of warm de-ionized water. The rings each were submerged for approximately sixty seconds in this solution. The rings were then removed, rinsed and patted dry. The silver ring was nearly black in appearance. By contrast, the alloy ring was only slightly darkened.

Although the invention has been described in terms of its preferred embodiments, other embodiments will be apparent to those of skill in the art from a review of the foregoing. Those embodiments as well as the preferred embodiments are intended to be encompassed by the scope and spirit of the following claims.

I claim:

1. A jewelry article selected from the group consisting of rings, earrings, settings, pendants, bracelets, chains, cufflinks, watch bands, watch pins, and clasps wherein the jewelry article is comprised of a corrosion resistant precious metal alloy comprising:

a. between about fifty-one to fifty-five percent by weight silver;

b. between about twenty-two to twenty-seven percent by weight palladium;

c. between about seventeen to twenty-three percent by weight copper; and d. wherein the article has an as cast hardness value on the Vicker's scale that is susceptible to increase via age hardening and wherein the alloy is substantially white in color.

2. A jewelry article according to claim 1 wherein said alloy further comprises up to about three percent by weight of an element selected from the group consisting of zinc, silicon, and combinations thereof.

3. A jewelry article according to claim 2 wherein said alloy further comprises up to about one percent by weight of a grain refiner.

4. A jewelry article according to claim 3 wherein said grain refiner is selected from the group comprising ruthenium, iridium, and combinations thereof.

5. A jewelry article according to claim 1 wherein the alloy has a CIELAB L value above about 80; a CIELAB a* value between about −1.0 and 1.0; and a CIELAB b* value below about 7.0.

6. A jewelry article according to claim 5 wherein the alloy has a yellowness index below about 19.

7. A jewelry article according to claim 6 wherein said article is substantially free of nickel.

8. A jewelry article according to claim 1 wherein the alloy has a yellowness index below about 19.

9. A jewelry article according to claim 8 wherein said article is substantially free of nickel.

10. A jewelry article according to claim 1 wherein the alloy has a silver to copper ratio of between about 3:1 and about 2:1.

11. A jewelry article according to claim 10 wherein the alloy has a silver to copper ratio of about 2.6:1.

12. A jewelry article according to claim 1 wherein the as cast hardness value of the article is about 140 on the Vicker's scale.

13. A jewelry article according to claim 12 wherein the article has an as cast yield point between about 23 and 30 kilo-pounds per square inch.

14. A jewelry article according to claim 12 wherein the jewelry article has been age hardened.

15. A jewelry article according to claim 14 wherein the jewelry article has a post-age hardening hardness value on the Vicker's scale of at least about 200.

16. A jewelry article according to claim 15 wherein the jewelry article has a post-age hardening hardness value on the Vicker's scale of about 240.

17. A jewelry article according to claim 14 wherein the article has a post-age hardening yield point of between about 2900 and about 3300 kilo-pounds per square inch.

18. A jewelry article according to claim 14 wherein the article has a post-age hardening yield point of at least about 3300 kilo-pounds per square inch.

19. A jewelry article according to claim 1 wherein the alloy is substantially free of gold.

20. A jewelry article according to claim 1 wherein the corrosion resistant precious metal alloy consists essentially of:

a. between about fifty-one to fifty-five percent by weight silver;
b. between about twenty-two to twenty-seven percent by weight palladium; and
c. between about seventeen to twenty-three percent by weight copper.

21. A jewelry article selected from the group consisting of rings, earrings, settings, bracelets, pendants, chains, cuff-links, watch bands, watch pins, and clasps wherein the jewelry article is comprised of a corrosion resistant precious metal alloy comprising:

a. about 53.75 percent by weight silver;
b. about 24.75 percent by weight palladium;
c. about 20.75 percent by weight copper; and
d. wherein the article has an as cast hardness value on the Vicker's scale that is susceptible to increase via age hardening.

22. A jewelry article accordingly to claim 21 wherein said alloy further comprises up to about three percent by weight of an element selected from the group consisting of zinc, silicon, and combinations thereof.

23. A jewelry article according to claim 21 wherein said alloy further comprises up to about one percent by weight of a grain refiner.

24. A jewelry article according to claim 23 wherein said grain refiner is selected from the group comprising ruthenium, iridium, and combinations thereof.

25. A jewelry article according to claim 21 wherein said alloy is substantially free of nickel.

26. A method of making one or more jewelry articles according to claim 21 wherein the corrosion resistant precious metal alloy consists essentially of:

a. about 53.75 percent by weight silver;
b. about 24.75 percent by weight palladium; and
c. about 20.75 percent by weight copper.

27. A method of making one or more jewelry articles comprising:

a. placing casting grains of a corrosion resistant precious metal alloy in a crucible, wherein said corrosion resistant precious metal alloy comprises
   i. between about fifty-one to fifty-five percent by weight silver;
   ii. between about twenty-two to twenty-seven percent by weight palladium; and
   iii. between about seventeen to twenty-three percent by weight copper;
b. completely melting said casting grains by heating said crucible to a temperature between about 1600° F. and 1800° F.;
c. pouring said molten alloy into an investment mold containing at least one jewelry article shaped cavity;
d. allowing said molten alloy to cool and solidify within said investment mold to form said one or more jewelry articles having an as cast hardness value on the Vicker's scale that is susceptible to increase via age hardening;
e. removing said investment mold from said solidified one or more jewelry articles; and
f. polishing said one or more jewelry articles until said one or more jewelry articles are substantially white in color.

28. A method of making one or more jewelry articles according to claim 27 wherein said alloy further comprises up to about three percent by weight of an element selected from the group consisting of zinc, silicon, and combinations thereof.

29. A method of making one or more jewelry articles according to claim 28 wherein said alloy further comprises up to about one percent by weight of a grain refiner.

30. A method of making one or more jewelry articles according to claim 29 wherein said grain refiner is selected from the group comprising ruthenium, iridium, and combinations thereof.

31. A method of making one or more jewelry articles according to claim 27 wherein the polished one or more jewelry articles have a CIELAB L* value above about 80; a CIELB a* value between about −1.0 and 1.0; and a CIELAB b* value below about 7.0.

32. A method of making one or more jewelry articles according to claim 31 wherein the polished one or more jewelry articles have a yellowness index below about 19.

33. A method of making one or more jewelry articles according to claim 32 wherein said alloy is substantially free of nickel.

34. A method of making one or more jewelry articles according to claim 27 wherein the polished one or more jewelry articles have a yellowness index below about 19.

35. A method of making one or more jewelry articles according to claim 34 wherein said alloy is substantially free of nickel and gold.

36. A method of making one or more jewelry articles according to claim 27 wherein the alloy has a silver to copper ratio of between about 3:1 and about 2:1.

37. A method of making one or more jewelry articles according to claim 36 wherein the alloy has a silver to copper ratio of about 2.6:1.

38. A method of making one or more jewelry articles according to claim 27 wherein the as cast hardness value on the Vicker's scale of said one or more jewelry articles is not higher than about 140.

39. A method of making one or more jewelry articles according to claim 38 wherein the article has an as cast yield point between about 23 and 30 kilo-pounds per square inch.

40. A method of making one or more jewelry articles according to claim 38 wherein the method further comprises age hardening the one or more solidified jewelry articles.

41. A method of making one or more jewelry articles according to claim 40 wherein the jewelry articles have a post-age hardening hardness value on the Vicker's scale of at least about 200.

42. A method of making one or more jewelry articles according to claim 41 wherein the jewelry articles have a post-age hardening hardness value on the Vicker's scale of about 240.

43. A method of making one or more jewelry articles according to claim 40 wherein the jewelry articles have a post-age hardening yield point of between about 2900 and about 3300 kilo-pounds per square inch.

44. A method of making one or more jewelry articles according to claim 40 wherein the jewelry articles have a post-age hardening yield point of at least about 3300 kilopounds per square inch.

45. A method of making one or more jewelry articles according to claim 40 wherein the step of age hardening comprises placing said one or more jewelry articles into an oven preheated to between about 600° and 800° F.; holding said one or more jewelry articles in said oven for about thirty minutes; and removing said jewelry articles from said oven.

46. A method of making one or more jewelry articles according to claim 27 wherein said investment mold has been pre-heated to about 900° F. at the time said molten alloy is poured into said investment mold.

47. A method of making one or more jewelry articles according to claim 32 wherein said investment mold is substantially static when said molten alloy is poured into said investment mold.

48. A method of making one or more jewelry articles according to claim 47 wherein said molten alloy will not solidify within said pre-heated investment mold for at least about five seconds after pouring.

49. A method of making one or more jewelry articles according to claim 27 wherein the corrosion resistant precious metal alloy consists essentially of:

a. between about fifty-one to fifty-five percent by weight silver;

b. between about twenty-two to twenty-seven percent by weight palladium; and c. between about seventeen to twenty-three percent by weight copper.

* * * * *